United States Patent [19]

Knight et al.

[11] Patent Number: 5,030,379

[45] Date of Patent: Jul. 9, 1991

[54] PROCESS FOR PREPARING HIGH BULK DENSITY DETERGENT POWDERS ADMIXED WITH ZEOLITE AND COATED WITH NONIONIC SURFACTANT

[75] Inventors: Peter C. Knight, South Wirral; Thomas Taylor, Cheshire, both of England

[73] Assignee: Lever Brothers Company, Division of Conopco, Inc., New York, N.Y.

[21] Appl. No.: 344,800

[22] Filed: Apr. 28, 1989

[30] Foreign Application Priority Data

May 6, 1988 [GB] United Kingdom ..... 8810821

[51] Int. Cl.[5] ..... C11D 11/00; C11D 1/66; C11D 3/12; C11D 17/06

[52] U.S. Cl. ..... 252/174.25; 252/174.13; 252/174.14; 252/174.21; 252/559; 252/DIG. 1

[58] Field of Search ..... 252/174.13, 174.15, 252/174.25, 174, 367–370, DIG. 1, 559, 174.14, 174.21

[56] References Cited

U.S. PATENT DOCUMENTS

| | | | |
|---|---|---|---|
| 4,231,887 | 11/1980 | Denny et al. | 252/174.19 |
| 4,738,793 | 4/1988 | Travill | 252/135 |
| 4,818,424 | 4/1989 | Evans et al. | 252/91 |
| 4,923,628 | 5/1990 | Appel et al. | 252/135 |
| 4,931,203 | 6/1990 | Ahmed et al. | 252/99 |
| 4,965,015 | 10/1990 | Heykourne et al. | 252/174.25 |
| 4,970,017 | 11/1990 | Nakamura et al. | 252/174.13 |

FOREIGN PATENT DOCUMENTS

| | | |
|---|---|---|
| 229671A | 7/1887 | European Pat. Off. . |
| 0061296 | 9/1982 | European Pat. Off. . |
| 61296A | 9/1982 | European Pat. Off. . |
| 219314A | 4/1987 | European Pat. Off. . |
| 220024A | 4/1987 | European Pat. Off. . |
| 0229671 | 7/1987 | European Pat. Off. . |
| 267042A | 5/1988 | European Pat. Off. . |
| 3438654A | 5/1985 | Fed. Rep. of Germany . |
| 8421360B | 5/1984 | Japan . |
| 8441680B | 10/1984 | Japan . |
| 61-064798A | 4/1986 | Japan . |
| 61-69897 | 4/1986 | Japan . |
| 61-069897A | 4/1986 | Japan . |
| 555331 | 5/1986 | Spain . |
| 1591515 | 6/1981 | United Kingdom . |
| 1591517 | 6/1981 | United Kingdom . |
| 1591518 | 6/1981 | United Kingdom . |

OTHER PUBLICATIONS

GB Patent Office Search Report, Search date: 6/'88.
European Search Report–dated 4/2/90.

*Primary Examiner*—Paul Lieberman
*Assistant Examiner*—A. Beadles-Hay
*Attorney, Agent, or Firm*—J. J. Farrell

[57] ABSTRACT

A process for the preparation of a free-flowing detergent powder comprises the steps of (i) mixing a detergent base powder with finely divided zeolite in a weight ratio of the zeolite (hydrated basis) to the base powder of from 0.13:1 to 0.40:1, whereby the small zeolite particles are adhered to the outer surface of the larger base powder particles, and (ii) spraying a liquid composition comprising nonionic surfactant onto the mixture formed in step (i), at a weight ratio of nonionic surfactant to alkali metal aluminosilicate of at least 0.25:1. This improves flow properties, increases bulk density, and improves dispensing in an automatic washing machine.

21 Claims, No Drawings

PROCESS FOR PREPARING HIGH BULK DENSITY DETERGENT POWDERS ADMIXED WITH ZEOLITE AND COATED WITH NONIONIC SURFACTANT

TECHNICAL FIELD

The present invention relates to detergent powders and processes for preparing them. It is of especial applicability to powders containing no, or reduced levels of, phosphate builders and to powders of high bulk density.

BACKGROUND

In recent years the trend in detergent compositions has been towards reducing or eliminating phosphate builders. The replacement of sodium tripolyphosphate as a builder in powdered detergent compositions by crystalline sodium aluminosilicate (zeolite) and/or by sodium carbonate has led to a number of difficulties with the structure and properties of the powder. One such problem that has been encountered is the tendency to dispense less well in front-loading automatic washing machines than do similar phosphate-built powders: a higher proportion of the powder dosed into the machine is left behind in the dispenser, leading to product wastage and clogging. This problem is especially marked at the low wash temperatures now preferred for energy-saving reasons.

Another problem observed with zeolite-built powders is a relatively high level of insoluble matter deposited on the machine surfaces or on the washed fabrics.

Both these problems have been exacerbated by the recent trend in the detergents industry towards higher bulk density powders.

We have now found that high bulk density powders having improved flow and dispensing properties and low levels of insoluble matter can be prepared by coating the particles of a detergent base powder with a relatively large amount of finely divided zeolite powder, and then spraying on a liquid binder comprising nonionic surfactant.

PRIOR ART

JP 84 41680B (Kao) discloses a process in which a detergent base powder is mixed with up to 10% by weight, preferably 5% by weight, of finely divided (0.1–30 microns) crystalline or non-crystalline material selected from sodium aluminosilicate, calcium silicate, calcium carbonate, magnesium silicate and sodium carbonate, and a sticky binder, for example, a dihydric alcohol-ethylene oxide adduct, is simultaneously or subsequently sprayed on in a ratio to the finely divided powder of 0.2:1 to 1:1.

GB 1591517 (Colgate-Palmolive) discloses in claims 7 to 14 a process in which sodium tripolyphosphate and zeolite particles are mixed to form base beads with subsequent addition of liquid nonionic detergent. Optionally, such particles may be coated with further nonionic detergent followed by layering with fine zeolite particles. The reverse order of addition of zeolite and nonionic surfactant is not disclosed.

JP 61 069 897A (Kao) discloses in Example 2 a process in which 100 parts of spray-dried based powder are pulverised in a Fukae mixer, 4.6 parts of nonionic surfactant and 17 parts of aluminosilicate micropowder are added, and the mixture is granulated in the Fukae mixer. The weight ratio of zeolite to base is 0.17:1 and the weight ratio of nonionic surfactant to zeolite is 0.27:1. No further aluminosilicate is added after granulation.

EP 61 296A (Unilever) discloses a process in which a spray-dried base powder containing anionic surfactant and silicate is admixed with zeolite and a liquid binder, for example nonionic surfactant, then dried. Zeolite to base powder weight ratios in the Examples range from 0.65:1 to 1.33:1. Nonionic surfactant to zeolite weight ratios are comparatively low, ranging from 0.09:1 to 0.18:1.

DEFINITION OF THE INVENTION

The present invention provides a process for the preparation of a free-flowing detergent powder, which comprises the steps of (i) mixing a detergent base powder comprising one or more detergent-active compounds and one or more detergency builders with finely divided alkali metal aluminosilicate in a weight ratio of the alkali metal aluminosilicate (hydrated basis) to the base powder of from 0.13:1 to 0.40:1, whereby particles of crystalline sodium aluminosilicate are adhered to the outer surfaces of the particles of the base powder; and (ii) spraying a liquid composition comprising nonionic surfactant onto the mixture formed in step (i), at a weight ratio of nonionic surfactant to alkali metal aluminosilicate of at least 0.25:1.

The invention also provides a detergent powder prepared by the process defined in the previous paragraph.

DETAILED DESCRIPTION OF THE INVENTION

In step (i) of the process of the invention, finely divided alkali metal aluminosilicate (zeolite) is coated or "layered" onto the much larger particles of a detergent base powder. This simultaneously improves flow and other powder properties, for example, compressibility, and also raises bulk density. The amount of zeolite used in comparison to the base powder is so chosen as to allow for adequate "layering" and to increase the bulk density significantly. The weight ratio of added zeolite (hydrated basis) to base powder is from 0.13:1 to 0.40:1, preferably from 0.15:1 to 0.35:1, and desirably from 0.20:1 to 0.33:1.

The preferred alkali metal aluminosilicate for use in the process of the invention is crystalline sodium aluminosilicate (zeolite), more preferably Type A zeolite.

The process of the invention allows a base powder having a relatively low level of zeolite to be prepared, thus keeping to a minimum the problems associated with processing zeolite through a slurry and a spray-drying tower, and then bringing the level of zeolite up to that desired for good detergency building by "layering" in accordance with the invention.

Because "layering" of a substantial level of zeolite in accordance with the invention also raises the bulk density significantly, the process also allows a base powder of relatively low bulk density (less than 500 kg/m$^3$, for example, 400 to 500 kg/m$^3$) to be prepared and the bulk density brought to a desired high value, for example, above 500 kg/m$^3$, by appropriate choice of the level of "layered" zeolite. This procedure thus keeps to a minimum the problems associated with the production of a high bulk density spray-dried base powder having acceptable flow and other powder properties.

It is therefore clear that the process of the invention is of especial applicability to the treatment of base powders prepared by spray-drying. It is within the scope of the invention, however, for the base powder to be prepared by any suitable tower or non-tower method.

It is also clear that the process of the invention is especially relevant to the treatment of base powders containing alkali metal aluminosilicate. Preferably the amount of alkali metal aluminosilicate (anhydrous basis) in the base powder does not exceed 50% by weight. It is also within the scope of the invention for the base powder to be free of aluminosilicate. Whether or not aluminosilicate is present, the base powder may advantageously contain sodium carbonate, as builder and/or as pH regulator.

The base powder is preferably substantially free of inorganic phosphate builders.

The process of the invention is also especially useful for the treatment of a base powder containing a relatively high level, for example, at least 20% by weight, of detergent-active compounds. Such base powders can exhibit poor flow properties and a tendency to cake, and "layering" with aluminosilicate in accordance with the invention can bring about significant improvements in these respects.

According to step (ii) of the invention, after admixture of the aluminosilicate a liquid binder consisting of or comprising nonionic surfactant is sprayed onto the "layered" powder. It has been surprisingly found that if nonionic surfactant is sprayed on in a weight ratio of at least 0.25:1, based on the added aluminosilicate, the dispensing behaviour of the powder in an automatic washing machine can be substantially improved. The preferred weight ratio of nonionic surfactant to aluminosilicate (hydrated basis) is from 0.25:1 to 1:1, more preferably at least 0.30:1, and most preferably from 0.30:1 to 0.70:1.

This process of the invention results in reductions of dispenser residue (as hereinafter defined) of 20% by weight or more, preferably of at least 30% by weight, if the base powder has poor dispensing characteristics. This embodiment is therefore especially useful for the treatment of base powders giving dispenser residues of 30% by weight or more, especially those giving residues of 50% by weight or more, and more especially those giving residues of 70% by weight or more. Such base powders include in particular zero-phosphate compositions built with zeolite, sodium carbonate or a combination of the two; powders containing less than 10% by weight (or no) sodium silicate; and powders having a bulk density of 550 kg/m$^3$ or more. The preferred ratios for nonionic surfactant to added aluminosilicate given above apply especially to such powders; ratios outside those ranges are also within the scope of the invention because with other types of base powder they can give benefits.

The dispenser residue is the (dry) weight percentage of the total powder dose (100 g) left behind in the dispenser of a Philips (Trade Mark) AWB 126/7 front-loading washing machine operated using 5 liters of water at 20° C. flowing in over a period of 1 minute. These conditions of low water temperature and slow fill are deliberately chosen to be more severe than those likely to be encountered in normal usage, and the machine used for the test is one having a drawer-type dispenser that is particularly vulnerable to poor dispensing and clogging.

Any nonionic surfactant that is sufficiently liquid at ambient or slightly higher temperature (up to about 60° C.) may be used in the process of the invention. Suitable nonionic surfactants include the primary and secondary alcohol ethoxylates, especially the $C_{12}$–$C_{15}$ primary and secondary alcohols ethoxylated with 3–10 moles of ethylene oxide per mole of alcohol.

Step (i) of the process of the invention may be carried out in any suitable apparatus that provides thorough but not too vigorous mixing. The mixing conditions should be such as to break up any agglomerates in the aluminosilicate without breaking up the base powder particles. A pan granulator, concrete mixer or continuous drum mixer is suitable. Spraying on of nonionic surfactant in step (ii) may be carried out by any suitable method.

The base powder contains, as essential components, one or more detergent-active compounds and one or more detergency builders, and it may of course contain other conventional ingredients.

The base powder may contain detergent-active compounds (surfactants) of any type. Of particular interest are anionic surfactants and nonionic surfactants. Both types are well known to those skilled in the art. Preferred detergency builders are zeolite and/or sodium carbonate. Other builders that may additionally or alternatively be present include polycarboxylate polymers such as polyacrylates, acrylic/maleic copolymers or acrylic phosphinates; monomeric polycarboxylates such as nitrilotriacetates, citrates and ethylenediaminetetraacetates; and many other materials known to the skilled detergent formulator. If desired, the base powder may contain sodium silicate; in the case of a spray-dried base powder containing aluminosilicate, however, the amount should not be so high that unacceptable levels of insoluble siliceous species are formed by reaction between aluminosilicate and silicate in the slurry.

Other materials that may be present in powders prepared by the process of the invention include fluorescers, antiredeposition agents, inorganic salts such as sodium sulphate, enzymes, lather control agents, bleaches, bleach activators and bleach stabilisers. As is well known to the skilled formulator, some of these materials are not suitable for undergoing slurry-making and spray-drying, and are preferably not included in a spray-dried base powder: such materials are advantageously postdosed after the aluminosilicate "layering" of the invention. This restriction does not necessarily apply to base powders prepared by non-tower methods, but it may still be advantageous to postdose certain ingredients, notably bleaches, enzymes and lather control agents.

The invention is further illustrated by the following non-limiting Examples, in which parts and percentages are by weight unless otherwise stated.

EXAMPLES

Examples 1 to 3

A base powder (Control A) was prepared to the composition shown below by spray-drying an aqueous slurry:

| | Parts | % |
|---|---|---|
| Sodium alkylbenzene sulphonate | 9.0 | 23.75 |
| Nonionic surfactant | 1.0 | 2.64 |
| Zeolite HAB A40 (anhydrous basis) | 16.0 | 42.22 |
| Sodium carbonate | 2.0 | 5.28 |
| Sodium polyacrylate | 4.0 | 10.55 |
| Minor ingredients | 0.84 | 2.22 |
| Water | 5.06 | 13.35 |

-continued

| | Parts | % |
|---|---|---|
| | 37.9 | 100.00 |

This powder had a Rosin-Rammler mean particle size of 550 microns.

3 parts of liquid nonionic surfactant were sprayed onto this powder (Control B). Various amounts of Type A zeolite (Wessalith (Trade Mark) P ex Degussa) were admixed with samples of Control A, as shown in Table 1, in a baffled rotating mixer for 5 minutes; in Examples 1 to 3, nonionic surfactant (3 parts) was then sprayed on while mixing was continued. Comparative Example C did not have nonionic surfactant sprayed on; comparative Examples D and E have nonionic : zeolite ratios of less than 0.25:1, also Example E has a zeolite : base powder ratio greater than 0.40:1. The properties of the resulting powders are shown in Table 1.

TABLE 1

| | A | B | C |
|---|---|---|---|
| Parts: | | | |
| Base powder | 37.9 | 37.9 | 37.9 |
| Nonionic surfactant | — | 3.0 | — |
| Zeolite (hydrated) | — | — | 10.0 |
| Total | 37.9 | 40.9 | 47.9 |
| Weight ratios: | | | |
| zeolite:base powder | — | — | 0.26 |
| nonionic:zeolite | — | — | 0 |
| Properties: | | | |
| Bulk density (kg/m$^3$) | 514 | 475 | 595 |
| Flow rate (ml/s) | 105 | 64 | 105 |
| Compressibility (% v/v) | 25 | 34 | 16 |
| Dispenser residue (%) | 100 | 100 | 100 |

| | 1 | 2 | 3 |
|---|---|---|---|
| Parts: | | | |
| Base powder | 37.9 | 37.9 | 37.9 |
| Nonionic surfactant | 3.0 | 3.0 | 3.0 |
| Zeolite (hydrated) | 5.0 | 7.5 | 10.0 |
| Total | 45.9 | 48.4 | 50.9 |
| Weight ratios: | | | |
| zeolite:base powder | 0.13 | 0.20 | 0.26 |
| nonionic:zeolite | 0.6 | 0.4 | 0.3 |
| Properties: | | | |
| Bulk density (kg/m$^3$) | 573 | 633 | 618 |
| Flow rate (ml/s) | 100 | 114 | 114 |
| Compressibility (% v/v) | 15 | 19 | 18 |
| Dispenser residue (%) | 75 | 65 | 60 |

| | D | E |
|---|---|---|
| Parts: | | |
| Base powder | 37.9 | 37.9 |
| Nonionic surfactant | 3.0 | 3.0 |
| Zeolite (hydrated) | 15.0 | 20.0 |
| Total | 55.9 | 60.9 |
| Weight ratios: | | |
| zeolite:base powder | 0.40 | 0.53 |
| nonionic:zeolite | 0.2 | 0.15 |
| Properties: | | |
| Bulk density (kg/m$^3$) | 585 | 600 |
| Flow rate (ml/s) | 97 | 93 |
| Compressibility (% v/v) | 25 | 33 |
| Dispenser residue (%) | 100 | 100 |

Examples 4 to 6

The procedure of Examples 1 to 3 was repeated using a higher level (4.0 parts) of sprayed-on nonionic surfactant. The results are shown in Table 2. As in previous Examples, each powder contained 37.9 parts of base powder A. Control F was the base powder Control A with 4.0 parts of nonionic surfactant sprayed on.

TABLE 2

| | F | 4 | 5 | 6 |
|---|---|---|---|---|
| Zeolite (hydrated) | — | 7.5 | 10.0 | 12.5 |
| Total | 41.9 | 49.4 | 51.9 | 53.4 |
| zeolite:base | — | 0.20 | 0.26 | 0.33 |
| nonionic:zeolite | — | 0.53 | 0.40 | 0.32 |
| Bulk density (kg/m$^3$) | 460 | 600 | 617 | 615 |
| Flow rate (ml/s) | 0 | 120 | 120 | 120 |
| Compressibility (%) | 40 | 25 | 22 | 22 |
| Dispenser residue (%) | 100 | 40 | 70 | 70 |

The large effect on bulk density, powder properties and dispenser residues at this nonionic surfactant level will be noted.

Examples 7 to 10

The procedure of Examples 4 to 6 was repeated using a higher level (5.0 parts) of sprayed-on nonionic surfactant. The results are shown in Table 3. As in previous Examples, each powder contained 37.9 parts of base powder A. Control G was the base powder Control A with 5.0 parts of nonionic surfactant sprayed on.

TABLE 3

| | G | 7 |
|---|---|---|
| Parts: | | |
| Zeolite (hydrated) | — | 5.0 |
| Total | 42.9 | 47.9 |
| zeolite:base powder | — | 0.13 |
| nonionic:zeolite | — | 1.0 |
| Bulk density (kg/m$^3$) | 450 | 557 |
| Flow rate (ml/s) | 0 | 78 |
| Compressibility (% v/v) | 50 | 28 |
| Dispenser residue (%) | 100 | 75 |

| | 8 | 9 | 10 |
|---|---|---|---|
| Parts: | | | |
| Zeolite (hydrated) | 7.5 | 10.0 | 12.5 |
| Total | 50.4 | 52.9 | 54.4 |
| zeolite:base powder | 0.20 | 0.26 | 0.33 |
| nonionic:zeolite | 0.67 | 0.5 | 0.4 |
| Bulk density (kg/m$^3$) | 610 | 600 | 633 |
| Flow rate (ml/s) | 111 | 114 | 120 |
| Compressibility (% v/v) | 20 | 21 | 18 |
| Dispenser residue (%) | 40 | 50 | 35 |

We claim:

1. A process for the preparation of a free-flowing detergent powder, which comprises the steps of (i) thoroughly mixing a spray dried detergent base powder in such a manner as to preserve the spray dried particles, said base powder particles comprising at least 20% by weight of one or more detergent-active compounds and one or more detergency builders with finely divided alkali metal aluminosilicate in a weight ratio of the alkali metal aluminosilicate (hydrated basis) to the base powder of from 0.13:1 to 0.40:1, whereby particles of alkali metal aluminosilicate are adhered to the outer surfaces of the particles of the base powder; and (ii) subsequently spraying a liquid composition comprising nonionic surfactant onto the mixture formed in step (i), at a weight ratio of nonionic surfactant to alkali metal aluminosilicate of at least 0.25:1.

2. A process as claimed in claim 1, wherein the weight ratio of alkali metal aluminosilicate to base powder is from 0.15:1 to 0.35:1.

3. A process as claimed in claim 2, wherein the weight ratio of alkali metal aluminosilicate to base powder is from 0.20:1 to 0.33:1.

4. A process as claimed in claim 1 wherein the aluminosilicate is present as the crystalline sodium salt.

5. A process as claimed in claim 1, wherein the alkali metal aluminosilicate is Type A zeolite.

6. A process as claimed in claim 1, wherein nonionic surfactant is sprayed on in a weight ratio to the alkali metal aluminosilicate of from 0.25:1 to 1.00:1.

7. A process as claimed in claim 1, wherein nonionic surfactant is sprayed on in a weight ratio to the alkali metal aluminosilicate of at least 0.30:1.

8. A process as claimed in claim 6, wherein nonionic surfactant is sprayed on in a weight ratio to the alkali metal aluminosilicate of from 0.30:1 to 0.70:1.

9. A process as claimed in claim 1, wherein the powder obtained, after the admixture of the alkali metal aluminosilicate and the spray-on of the nonionic surfactant, gives a dispenser residue (as hereinbefore defined) at least 20% by weight less than that given by the base powder.

10. A process as claimed in claim 9, wherein the powder obtained, after the admixture of the alkali metal aluminosilicate and the spray-on of the nonionic surfactant, gives a dispenser residue (as hereinbefore defined) at least 30% by weight less than that given by the base powder.

11. A process as claimed in claim 1, wherein the base powder gives a dispenser residue (as hereinbefore defined) of at least 30% by weight.

12. A process as claimed in claim 11, wherein the base powder gives a dispenser residue (as hereinbefore defined) of at least 50% by weight.

13. A process as claimed in claim 11, wherein the base powder gives a dispenser residue (as hereinbefore defined) of at least 70% by weight.

14. A process as claimed in claim 1, wherein the base powder has a bulk density of less than 500 $kg/m^3$.

15. A process as claimed in claim 14, wherein the base powder has a bulk density within the range of from 400 to 500 $kg/m^3$.

16. A process as claimed in claim 1, wherein the base powder contains not more than 50% alkali metal aluminosilicate.

17. A process as claimed in claim 1, wherein the base powder contains at least 5% sodium carbonate.

18. A process as claimed in claim 1, wherein the base powder is substantially free of inorganic phosphate builders.

19. A process as claimed in claim 1, wherein the base powder is prepared by spray-drying an aqueous slurry.

20. A detergent powder prepared by a process as claimed in claim 1.

21. A detergent powder as claimed in claim 20, having a bulk density of at least 500 $kg/m^3$.

* * * * *